US005534829A

United States Patent [19]

Kobayashi et al.

[11] Patent Number: 5,534,829

[45] Date of Patent: Jul. 9, 1996

[54] ANTENNA DUPLEXER

[75] Inventors: Yasumi Kobayashi; Kousuke Takeuchi; Yasuhiro Hirao; Kenichi Shibata, all of Osaka-fu, Japan

[73] Assignee: Sanyo Electric Co., Ltd., Moriguchi, Japan

[21] Appl. No.: 249,012

[22] Filed: May 25, 1994

[30] Foreign Application Priority Data

May 31, 1993 [JP] Japan ..... 5-154132

[51] Int. Cl.[6] ..... H01P 1/213

[52] U.S. Cl. ..... 333/126; 333/129; 333/134; 333/206; 455/83; 370/38

[58] Field of Search ..... 333/126, 129, 333/134, 206; 455/78, 80, 83, 82; 370/38, 36

[56] References Cited

U.S. PATENT DOCUMENTS

| | | | |
|---|---|---|---|
| 5,023,866 | 6/1991 | De Muro | 333/126 X |
| 5,293,141 | 3/1994 | Kobayashi et al. | 333/134 X |
| 5,323,127 | 6/1994 | Komazaki et al. | 333/126 |
| 5,374,906 | 12/1994 | Noguchi et al. | 333/134 |
| 5,375,256 | 12/1994 | Yokoyama et al. | 333/129 X |

FOREIGN PATENT DOCUMENTS

| | | | |
|---|---|---|---|
| 101 | 1/1987 | Japan | 333/134 |
| 136105 | 6/1987 | Japan | 333/134 |
| 187626 | 8/1991 | Japan | 333/126 |

*Primary Examiner*—Benny Lee

*Attorney, Agent, or Firm*—Armstrong, Westerman, Hattori, McLeland & Naughton

[57] ABSTRACT

An object of the present invention is to improve the characteristics of the conventional antenna duplexer and to provide an antenna duplexer contributing to higher performance and smaller size of a mobile communication apparatus. The antenna duplexer has a filter for wave receiving and a filter for wave transmission, and respective one ends of both the filters are connected to an antenna shared terminal through a matching circuit constituted by transmission lines. The characteristic impedance of at least one of a transmission line for connecting the antenna shared terminal and the filter for wave receiving to each other and a transmission line for connecting the antenna shared terminal and the filter for wave transmission to each other is set to a value other than the standard characteristic impedance of a receiver circuit and a transmitter circuit connected to the antenna duplexer. The total impedance of the filters for wave transmission and wave receiving and the respective transmission lines is set to the standard characteristic impedance.

12 Claims, 7 Drawing Sheets

ANTENNA DUPLEXER

BACKGROUND OF THE INVENTION

1. Field of the Invention

The present invention relates to an antenna duplexer utilized for mobile communication or the like.

2. Description of the Prior Art

In mobile communication such as a radio telephone, a potable telephone and an automobile telephone have been put to practical use, consumer demand is for mobile communication apparatuses be which lightweight and small in size. In such apparatuses, transmission and receiving must be made by a common antenna, and a circuit for wave transmission and a circuit for wave receiving must be separated in a high frequency manner. Examples of an apparatus used for such purposes include an antenna switch and a circulator. When the frequencies of a transmitted wave and a received wave differ from each other, an antenna duplexer is generally used.

FIG. 6 is a perspective view showing a conventional antenna duplexer. This conventional antenna duplexer comprises a filter for wave receiving 50, a filter for wave transmission 60 and a matching circuit 70. The filter for wave receiving 50 has properties of passing a received wave and preventing a transmitted wave. In the filter for wave receiving 50, three coaxial resonators 51, 52 and 53 are connected to each other through a dielectric substrate 58, to constitute a polarized band-pass filter. The filter for wave receiving 50 comprises interstage coupling chip capacitors 55 and 56 and input-output coupling chip capacitors 54 and 57 which are connected to electrodes for coupling the coaxial resonators 51, 52 and 53. The dielectric substrate 58 on which the coaxial resonators 51, 52, and 53 are mounted is disposed on a dielectric substrate carrier 40 having a ground electrode formed on its reverse surface.

On the other hand, the filter for wave transmission 60 has properties for passing a transmitted wave and preventing a received wave. In the filter for wave receiving 60, three coaxial resonators 61, 62 and 63 are connected to each other through a dielectric substrate 68, to constitute a band-stop filter. The filter for wave transmission 60 comprises pattern inductors 64, 65, 66 and 67 formed on a dielectric substrate 68 connected to a capacitance forming electrode. The dielectric substrate 68 on which the coaxial resonators 61, 62 and 63 are mounted is disposed on the dielectric substrate carrier 40 having the ground electrode formed on its reverse surface.

The properties of each of the filters 50 and 60 are mostly determined by its input impedance. The filter is so constructed that the input impedance takes a value close to the standard characteristic impedance in a pass band, while taking a value deviating from the standard characteristic impedance, i.e., zero, infinity, or a pure imaginary number in a preventing band.

Mismatching of impedances is a problem when the filter for wave receiving 50 and the filter for wave transmission 60 are coupled in parallel. Specifically, an input impedance relative to a transmitted wave of the filter for wave receiving 50 or an input impedance relative to a received wave of the filter for wave transmission 60 take an finite value, so that the impedances are mismatched between both the filters 50 and 60 and an antenna shared terminal 1. In order to prevent this, the above described matching circuit 70 is provided between both the filters 50 and 60 and the antenna shared terminal 1. This matching circuit 70 is constituted by two strip lines 71 and 72 provided on the dielectric substrate.40. The strip line 71 is used as a matching circuit on the receiving side, and the strip line 72 is used as a matching circuit on the transmission side. Respective ends of the strip lines 71 and 72 are connected to the antenna shared terminal 1, the other end of the strip line 71 is connected to one end of the filter for wave receiving 50, and the other end of the strip line 72 is connected to one end of the filter for wave transmission 60. The respective ends of both the filters 50 and 60 are connected to the antenna shared terminal 1 through the strip lines 71 and 72, the other end 3 of the filter for wave receiving 50 is connected to a receiver circuit, and the other end 2 of the filter for wave transmission 60 is connected to a transmitter circuit.

In the conventional example shown in FIG. 6, the matching circuit 70 is realized by the strip lines. (transmission lines) having the standard characteristic impedance, for example, a characteristic impedance of 50 Ω. The phase of the wave is shifted in the matching circuit 70 to bring the input impedance of the filter in the preventing band near infinity, thereby to respectively match the input impedances of the filter 50 and the receiver circuit and the input impedances of the filter 60 and the transmitter circuit. An antenna duplexer thus constructed has a function of introducing the received wave from an antenna to the receiver circuit and introducing the transmitted wave from the transmitter circuit to the antenna.

FIG. 7 shows the characteristics of the antenna duplexer shown in FIG. 6. In FIG. 7, terminal numbers of an S parameter coincide with the terminal numbers shown in FIG. 6 (1: an antenna shared terminal, 2: a terminal for a transmitter circuit, 3: a terminal for a receiver circuit). The curves in FIG. 7 show variation of the parameter S with respect to frequency for three different reflection losses in decibels.

SUMMARY OF THE INVENTION

However, the properties of a filter are not ideal, and the impedance of the filter cannot be completely matched with the standard characteristic impedance even in a pass band. In a matching circuit using transmission lines having the standard characteristic impedance (50 Ω), therefore, it is difficult to make the characteristic impedance of the whole antenna duplexer equal to or more than the standard characteristic impedance when the input impedance in the pass band of the filter greatly deviates from its matched state, while it is difficult to obtain sufficient matching when the input impedance in a preventing band of the filter does not sufficiently deviate from its matched state.

An object of the present invention is to improve the characteristics of the above described antenna duplexer and to reduce its size, to provide an antenna duplexer contributing to higher performance and smaller size of a mobile communication apparatus.

The present invention is directed to an antenna duplexer having a dielectric filter for wave receiving and a dielectric filter for wave transmission, respective ends of both the dielectric filters being connected to an antenna shared terminal through a matching circuit constituted by transmission lines, wherein the characteristic impedance of at least one of the transmission line for connecting the antenna shared terminal and the dielectric filter for wave receiving to each other and the transmission line for connecting the antenna shared terminal and the dielectric filter for wave transmission to each other is set to a value other than the standard characteristic impedance of a receiver circuit and a transmitter circuit connected to the antenna duplexer, and the total impedance of the dielectric filters for wave transmission and wave receiving and the respective transmission lines is set to the standard characteristic impedance.

In the present invention, the characteristic impedance of the transmission line is set to a value other than the standard characteristic impedance, for example, 50 Ω, thereby making it possible to enhance the performance of the antenna duplexer.

Furthermore, the transmission line extends equivalently by dividing the transmission line into not less than two parts and coupling the parts to each other by a capacitive or inductive element, thereby making it possible to miniaturize the antenna duplexer.

Additionally, a part of the transmission line and a ground conductor are coupled to each other by a capacitive or inductive element, to miniaturize the antenna duplexer.

The present invention is directed to an antenna duplexer having a dielectric filter for wave receiving and a dielectric filter for wave transmission, respective ends of both the filters being connected to an antenna shared terminal through a matching circuit constituted by transmission lines, wherein in a case where the characteristic impedance, the propagation coefficient and the line length of the transmission line are respectively taken as Zo, β and l, the input impedance of the filter itself is taken as Zf, and an input impedance to an end, which is not connected to the filter, of the transmission line is taken as Zin, the impedance Zo, the propagation coefficient β, and the line length l of the transmission line are so determined that Zin in the following equation becomes the standard characteristic impedance:

$$Zin = \frac{Zf + j \cdot Zo \cdot \tan\beta \cdot 1}{Zo + j \cdot Zf \cdot \tan\beta \cdot 1} Zo$$

(where j is an imaginary unit)

The above described equation is adapted to the pass band and the preventing band of the filter, thereby to determine such a combination of Zo, β and l that Zin approaches the standard characteristic impedance in the pass band and approaches infinity in the preventing band. In such a manner, transmission lines respectively most suitable for the dielectric filter for wave receiving and the dielectric filter for wave transmission are designed and are connected to the antenna shared terminal, thereby making it possible to manufacture the most suitable matching circuit. Further, according to the present invention, the characteristics of the antenna duplexer can be enhanced without being limited to the properties of the filters.

The foregoing and other objects, features, aspects and advantages of the present invention will become more apparent from the following detailed description of the present invention.

DESCRIPTION OF THE PREFERRED EMBODIMENTS

Embodiments of the present invention will be described with reference to drawings.

Figure 1:
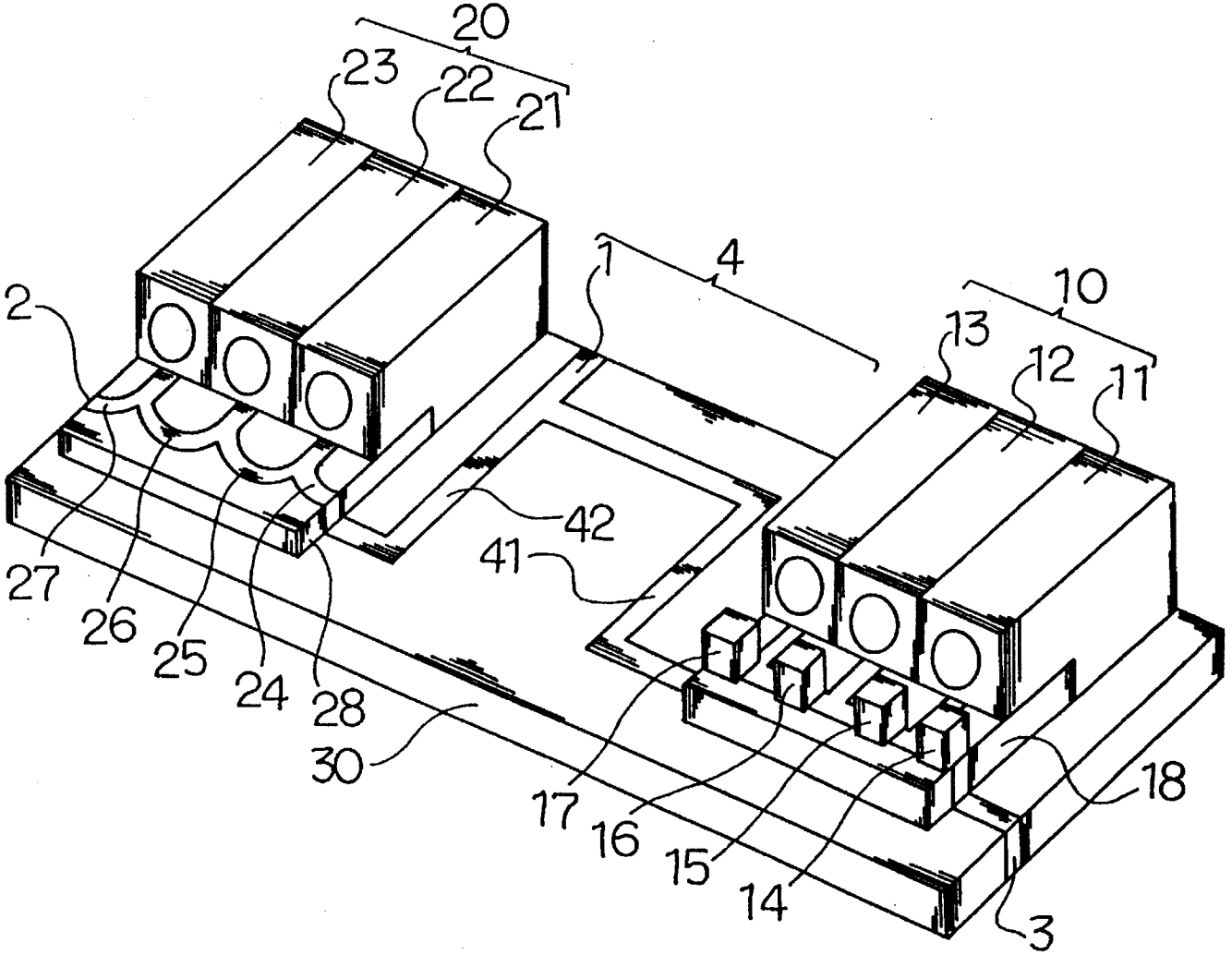
FIG. 1 is a perspective view showing a first embodiment of an antenna duplexer according to the present invention.

FIG. 1 is a perspective view showing a first embodiment of the present invention. A received wave band is set to 1.453 to 1.465 GHz, and a transmitted wave band is set to 1.501 to 1.513 GHz.

A filter for wave receiving 10 has the properties of such a band-pass filter having a pole that a received wave band is a pass band and a transmitted wave band is a preventing band. The filter for wave receiving 10 comprises three dielectric coaxial resonators 11, 12, 13 each constituted by an outer conductor provided on an outer peripheral surface of a dielectric member provided with a through hole and an inner conductor provided for the through hole, and chip capacitors 14, 15, 16, and 17 are respectively connected to the three coaxial resonators 11, 12 and 13 to constitute a polarized band-pass filter. Each of the coaxial resonators 11, 12 and 13 is a one-end face short-circuited type coaxial resonator in which an outer peripheral surface of ceramics of a $BaO—TiO_2—Nd_2O_3$ system provided with a through hole and an inner peripheral surface of the through hole are coated with a conductive material such as silver. Sides of the coaxial resonator in cross section perpendicular to the longitudinal direction are respectively 3 mm, the length of the coaxial resonator in the longitudinal direction is 6.8 mm, and the diameter of the through hole is 1.0 min. The coaxial resonator is provided with a depressed part formed by removing a portion of the outer conductor including the dielectric member by a depth of approximately 0.5 mm on the opened end side. A dielectric substrate 18 made of alumina is mounted on the depressed part. A capacitance forming electrode, an input-output electrode and an interstage coupling electrode are formed on the upper surface of the dielectric substrate 18. The capacitance forming electrode is opposed to the inner conductor through the dielectric member when the dielectric substrate 18 is mounted on the depressed parts of the coaxial resonators 11 to 13, to form antiresonance capacitance. The value of the antiresonance capacitance is determined depending on the area of the capacitance forming electrode, the distance between the inner conductor and the capacitance forming electrode, and the like. The larger the value of the antiresonance capacitance is, the deeper an attenuation pole in the properties of the filter is formed and the larger the difference between the resonance frequency and the antiresonance frequency is. An antenna shared terminal 1 is shown in FIG. 1, and the other end 2 of the filter is connected to a transmitter circuit.

The chip capacitors 14 to 17 are provided in predetermined places between the upper electrodes formed on the upper surface of the dielectric substrate 18. The chip capacitors 15 and 16 are used as interstage coupling capacitors respectively connected to the coupling electrode so as to couple the coaxial resonators 11 and 12 and the coaxial resonators 12 and 13. The chip capacitors 14 and 17 are used as input-output coupling capacitors respectively connected between the input-output electrode and the capacitance forming electrode. The input-output electrode is subjected to through-hole plating and is through-connected to an input-output stab electrode provided on the reverse surface of the dielectric substrate 18, and the input-output stab electrode is connected to a terminal for a receiver circuit 3.

Furthermore, the filter for wave transmission 20 has the properties of such a band preventing filter that a received wave band is a preventing band. In the filter for wave transmission 20, pattern inductors 24, 25, 26, and 27 are respectively connected to three dielectric coaxial resonators 21, 22 and 23, to constitute a band-stop filter. The coaxial resonators 21, 22 and 23 are one-end face short-circuited type coaxial resonators in which an outer peripheral surface of ceramics of a $BaO—TiO_2—Nd_2O_3$ system provided with a through hole and an inner peripheral surface of the through hole are coated with a conductive member such as silver, as in the filter for wave receiving 10. Sides of the coaxial resonator in cross section perpendicular to the longitudinal direction are respectively 3 mm, the length of the coaxial resonator in the longitudinal direction is 6.8 mm, and the diameter of the through hole is 2.6 mm. The coaxial resonator is provided with a depressed part formed by removing a part of the outer conductor including the dielectric member by a depth of approximately 0.5 mm on the opened end side.

A dielectric substrate 28 made of alumina is mounted on the depressed part. Capacitance forming electrodes and pattern inductors connected to the electrodes are formed on the upper surface of the dielectric substrate 28.

The filter for wave receiving 10 and the filter for wave transmission 20 are disposed on a dielectric substrate carrier 30 having a ground electrode formed on its reverse surface. A matching circuit 4 for connecting the filter for wave receiving 10 and the filter for wave transmission 20 to one antenna is provided on the upper surface of the dielectric substrate 30.

This matching circuit 4 is constituted by two transmission lines (strip lines) 41 and 42.

The filter for wave receiving (RK) 10 has properties of passing a received wave band and preventing a transmitted wave band, and the filter for transmission (Tx) 20 has properties of passing a transmitted wave band and preventing a received wave band. The standard characteristic impedance in the embodiment is 50 Ω. Consequently, each of the filters 10 and 20 is so constructed that the impedance in a pass band takes a value close to the standard characteristic impedance, i.e., 50 Ω.

Figure 2:
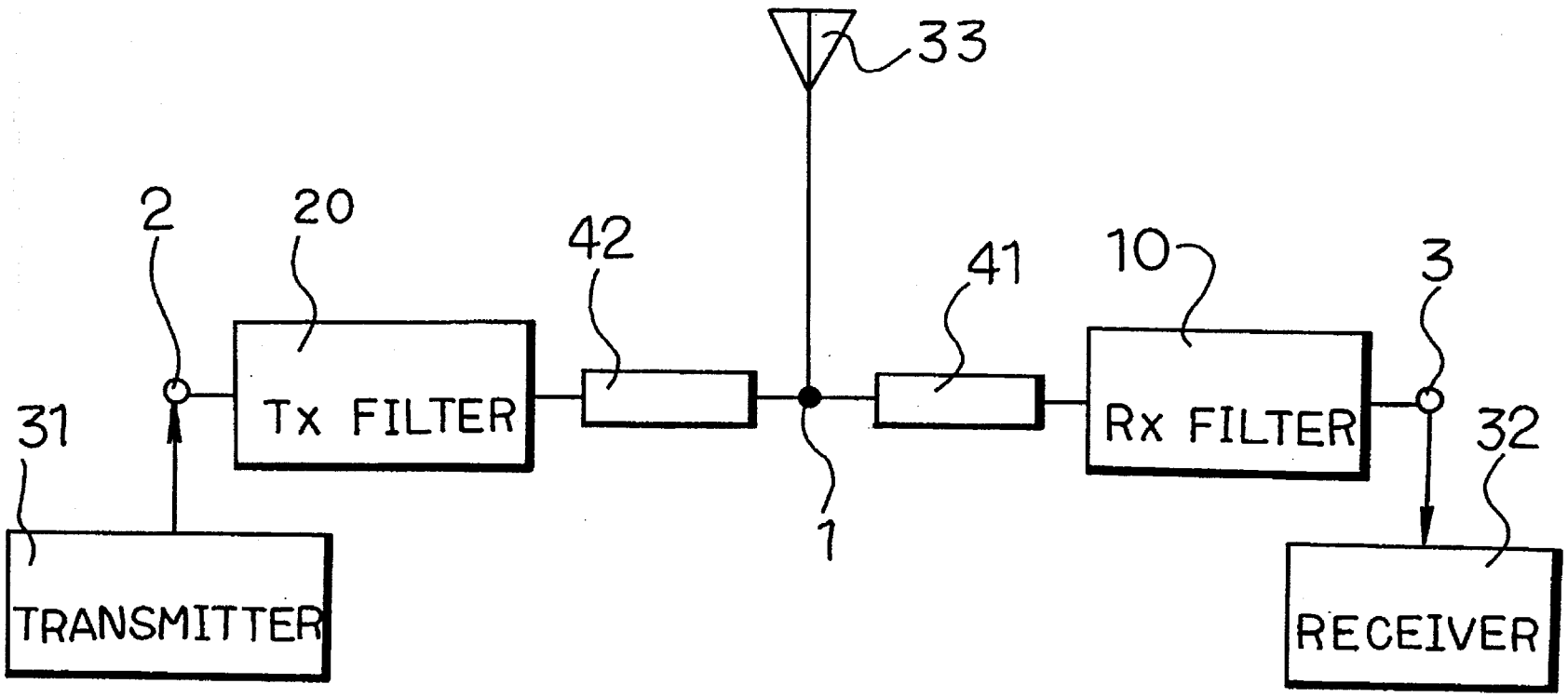
FIG. 2 is a schematic view showing an equivalent circuit of the antenna duplexer according to the present invention.

FIG. 2 is a circuit diagram showing the antenna duplexer. As shown in FIG. 2, the strip line 41 and the strip line 42 are respectively provided as a matching circuit on the receiving side and a matching circuit on the transmission side so as to connect the filter for wave receiving 10 and the filter for wave transmission 20 to one antenna. Respective ends of the strip lines 41 and 42 are connected to an antenna shared terminal 1, and an antenna 33 is connected to the antenna shared terminal 1. The other ends of the strip line 41 and the strip line 42 are respectively connected to one end of the filter for wave receiving 10 and one end of the filter for wave transmission 20. The respective one ends of both the filters 10 and 20 are connected to the antenna shared terminal 1 through the strip lines 41 and 42. The other end 3 of the filter for wave receiving 10 is connected to a receiver circuit 32, and the other end 2 of the filter for wave transmission 20 is connected to a transmitter circuit 31. This antenna duplexer has a function of introducing a received wave from the antenna 33 to the receiver circuit 32 and introducing a transmitted wave from the transmitter circuit 31 to the antenna 33.

The properties of each of the filters 10 and 20 are mostly determined by its input impedance. It is desired to construct the filter that the input impedance takes a value close to the standard characteristic impedance, i.e., 50 Ω in a pass band, while taking a value sufficiently deviating from 50 Ω, i.e., a value close to zero, infinity, or a pure imaginary number in a preventing band. Further, mismatching of the impedances is a problem when the filter for wave receiving 10 and the filter for wave transmission 20 are coupled to each other in parallel.

Figure 6:
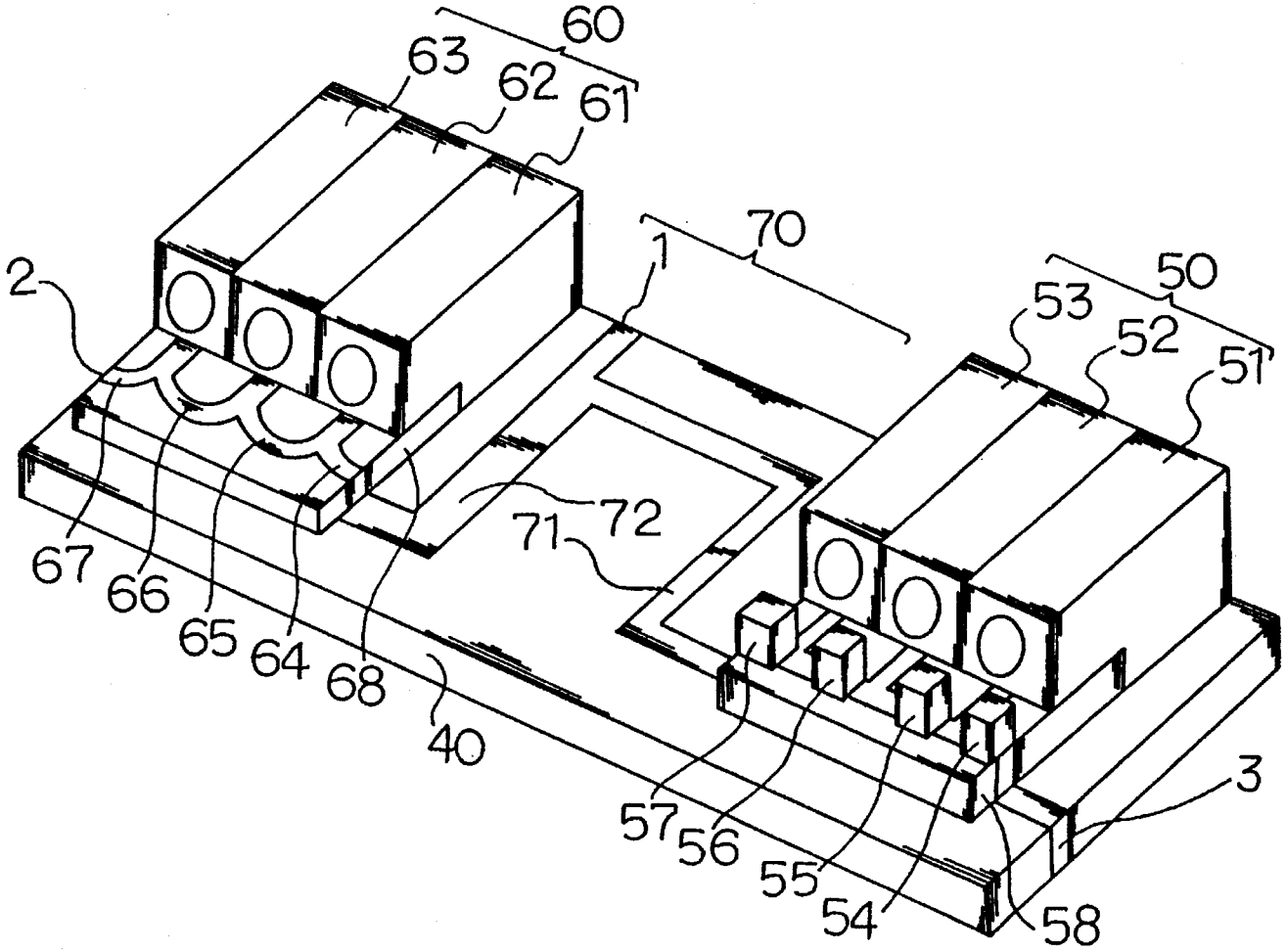
FIG. 6 PRIOR ART
FIG. 6 is a perspective view showing a conventional antenna duplexer.

For example, in the received wave band, the input impedance of the filter for wave receiving 10 takes a value close to 50 Ω, while the input impedance of the filter for wave transmission 20 is not generally increased to infinity. Accordingly, the input impedance as viewed from the antenna shared terminal 1 deviates from 50 Ω. The same problem also occurs in the transmitted wave band. In order to prevent this, the phase of the wave is shifted by respectively inserting the strip lines 71 and 72 having the characteristic impedance of 50 Ω between the filters for receiving and transmission 50 and 60 and the antenna shared terminal 1 as shown in FIG. 6 to bring the input impedances of the filters 50 and 60 in the preventing band near infinity, thereby to respectively match the input impedances of the filter 50 and the receiver circuit and the input impedances of the filter 60 and the transmitter circuit.

However, the properties of the filter are not ideal, and the input impedance of the filter is not completely matched with 50 Ω also in the pass band, as described above. Also in the antenna duplexer, therefore, the input impedance is not completely matched to 50 Ω even by simply shifting the phase of the wave in the transmission line having the impedance of 50 Ω, and the characteristics of the antenna duplexer are restricted by the properties of the filters. In order to solve this, the following measures are taken in the present invention.

For ideal properties of the matching circuit 4, it is desired that the input impedance of the filter in the pass band is matched with 50 Ω, and the input impedance thereof in the preventing band is matched with infinity. If a transmission line (a strip line) is used so as to realize the characteristics, three design parameters, that is, the characteristic impedance Zo, the propagation coefficient β and the line length l of the strip line are considered. In the actual strip line, if the dielectric constant and the thickness of the substrate are constant, Zo is a function of the width of the strip line, and β is a function of the width of the strip line and the frequency. Consider a structure in which the filter and the transmission line are connected in series. In this case, an input impedance Zin to an end, which is not connected to the filter, of the transmission line is represented by the following equation (1):

$$Zin = \frac{Zf + j \cdot Zo \cdot \tan\beta \cdot 1}{Zo + j \cdot Zf \cdot \tan\beta \cdot 1} Zo \quad (1)$$

(where Zf is the input impedance of the filter itself, and j is an imaginary unit)

This equation is adapted to the pass band and the preventing band of the filter, thereby to determine such a combination of Zo, β and l that Zin approaches the standard characteristic impedance, i.e., 50 Ω in the pass band and approaches infinity in the preventing band. At this time, it is clear that Zo and β are not independent, and a solution completely satisfying the 50 Ω conditions in the pass band and the infinity conditions in the preventing band does not generally exist from the foregoing equation (1). Accordingly, Zo, β and l leading to the conditions close to an ideal are determined by any numerical calculation method. Examples of a method of numerical calculation include a sequential calculation method and a Monte Carlo method.

Transmission lines respectively most suitable for the filter for wave receiving 10 and the filter for wave transmission 20 are designed by such a method and are connected to the antenna shared terminal, thereby making it possible to manufacture a matching circuit. Furthermore, the characteristics of the antenna duplexer can be enhanced without being limited to the properties of the filters.

As described above, the filter for wave receiving 10 according to the present embodiment comprises the three dielectric resonators 11 to 13, the four capacitive elements, that is, the chip capacitors 14 to 17. The input impedance Zf of the filter for wave receiving 10 is 47.3+j16.2 Ω in the received wave band, while $Z_f$ is 0.8+j10.9 Ω in the transmitted wave band.

Furthermore, the filter for wave transmission 20 comprises three dielectric resonators 21 to 23, the four inductive elements, that is, the pattern inductors 24 to 27. The input impedance Zf of the filter for wave transmission 20 is 3.3+j7.3 Ω in the received wave band, while $Z_f$ is 35.2–j6.5 Ω in the transmitted wave band.

Additionally, the dielectric constant of the dielectric substrate carrier 30 is 9, and the thickness thereof is 0.635 mm. The area of the whole antenna duplexer is approximately 25 mm×11 mm.

In the present embodiment, the strip lines 41 and 42 are determined using the above described method. The length of the strip line 41 for connecting the antenna shared terminal 1 and the filter for wave receiving 10 to each other is approximately 24 mm and the width thereof is approximately 0.6 mm, the characteristic impedance Zo is approximately 50 Ω, and the propagation coefficient β is 0.075 $mm^{-1}$. In addition, the length of the strip line 42 for connecting the antenna shared terminal 1 and the filter for wave transmission 20 to each other is approximately 15 mm and the width thereof is approximately 0.78 mm, the characteristic impedance is approximately 45 Ω, and the propagation coefficient β is 0.076 $mm^{-1}$. The input impedance Zin of each of the filters 10 and 20 in a case where the strip lines 41 and 42 are used as a matching circuit is as follows. The input impedance Zin is 47.4+j160.3 Ω in the received wave band and $Z_{in}$ is 44.0+j13.1 Ω in the transmitted wave band on the transmission side, while $Z_{in}$ is 42.0–313.3 Ω in the received wave band and $Z_{in}$ is 4.7–j113.7 Ω in the transmitted wave band on the receiving side.

Figure 3:
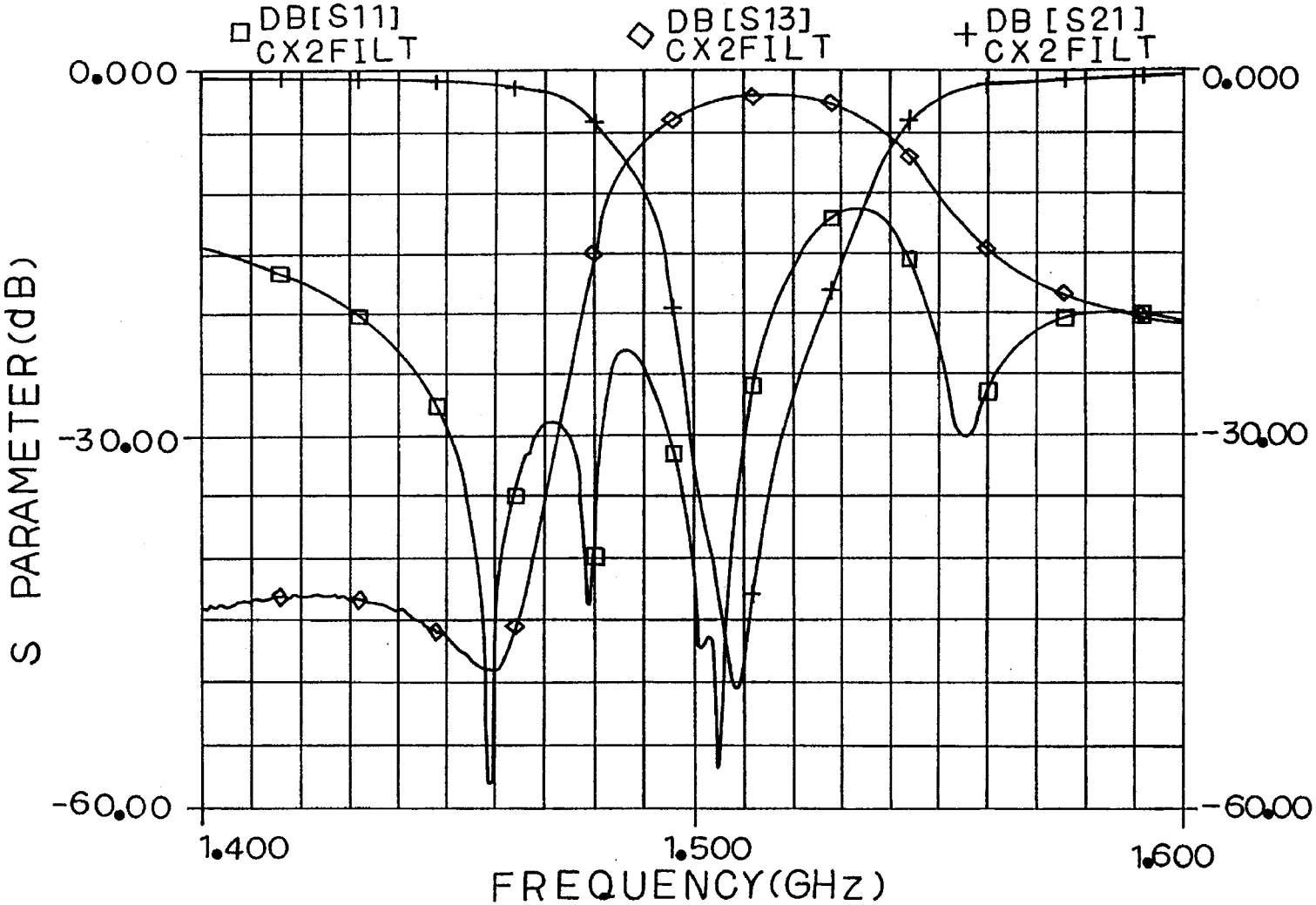
FIG. 3 is a view showing a first embodiment of the antenna duplexer according to the present invention.

FIG. 3 shows the characteristics of the antenna duplexer according to the embodiment shown in FIG. 1. In FIG. 3, terminal numbers of an S parameter coincide with terminal numbers shown in FIG. 1 (1: an antenna shared terminal, 2: a terminal for a transmitter circuit, 3: a terminal for a receiver circuit). In a state where matching is completely achieved, no reflection of the wave occurs, thereby making it possible to see a matched state by the magnitude of a reflection loss. As apparent from FIG. 3, the input impedances are matched in the present invention, so that a reflection loss S11 on the side of the antenna shared terminal is very large, i.e., 33 dB min, which shows that the present invention is suitable for practical applications.

Figure 4:
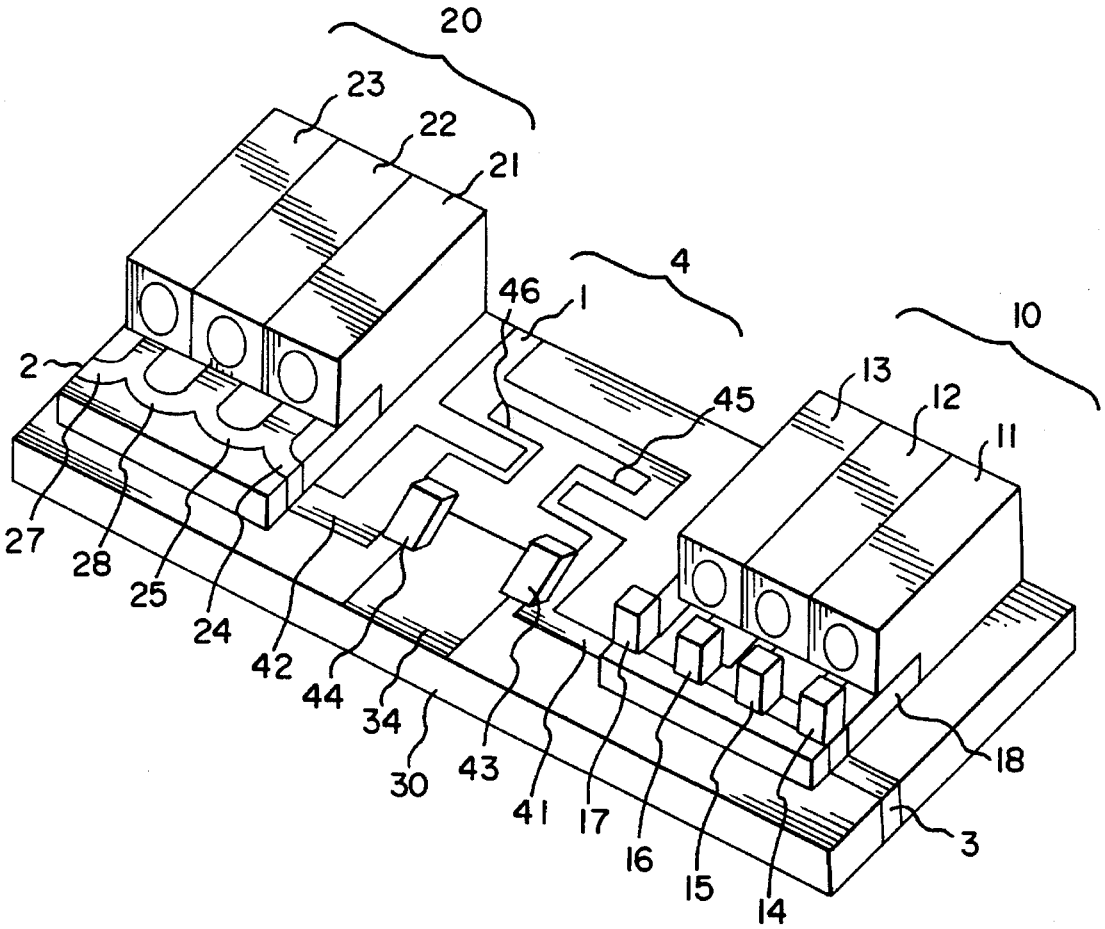
FIG. 4 is a perspective view showing a second embodiment of the antenna duplexer according to the present invention.

FIG. 4 is a perspective view showing an antenna duplexer according to a second embodiment of the present invention. The elements 1, 2, 3, 4, 10, 11, 12, 13, 14, 15, 16, 17, 18, 21, 22, 23, 24, 25, 26, 27, and 30 are the same as those shown in FIG. 1, and are therefore designated with the same numerals and names.

In the present embodiment, transmission lines (strip lines) 41 and 42 are respectively provided with capacitive elements 43 and 44. The value of the capacitive element 43 is 0.6 pF, and the value of the capacitive element 44 is 0.5 pF. The capacitive elements 43 and 44 respectively couple the ground electrode 34 having a through hole and the transmission lines 41 and 42.

Furthermore, the transmission lines 41 and 42 are respectively provided with inductive elements 45 and 46. The value of the inductive element 45 is 1.9 nH, and the value of the inductive element 46 is 1.3 nH. It goes without saying that the inductive elements 45 and 46 are respectively constituted by pattern inductors. The strip lines extend equivalently by inserting reactance elements which are the pattern inductors. Even if the length of the strip line for wave receiving is set to 18 mm and the length of the strip line for wave transmission is set to 12 mm, therefore, it is possible to obtain approximately the same characteristics as those in the embodiment shown in FIG. 1. In addition, the area of the whole antenna duplexer is approximately 23 mm×11 mm.

Figure 5:
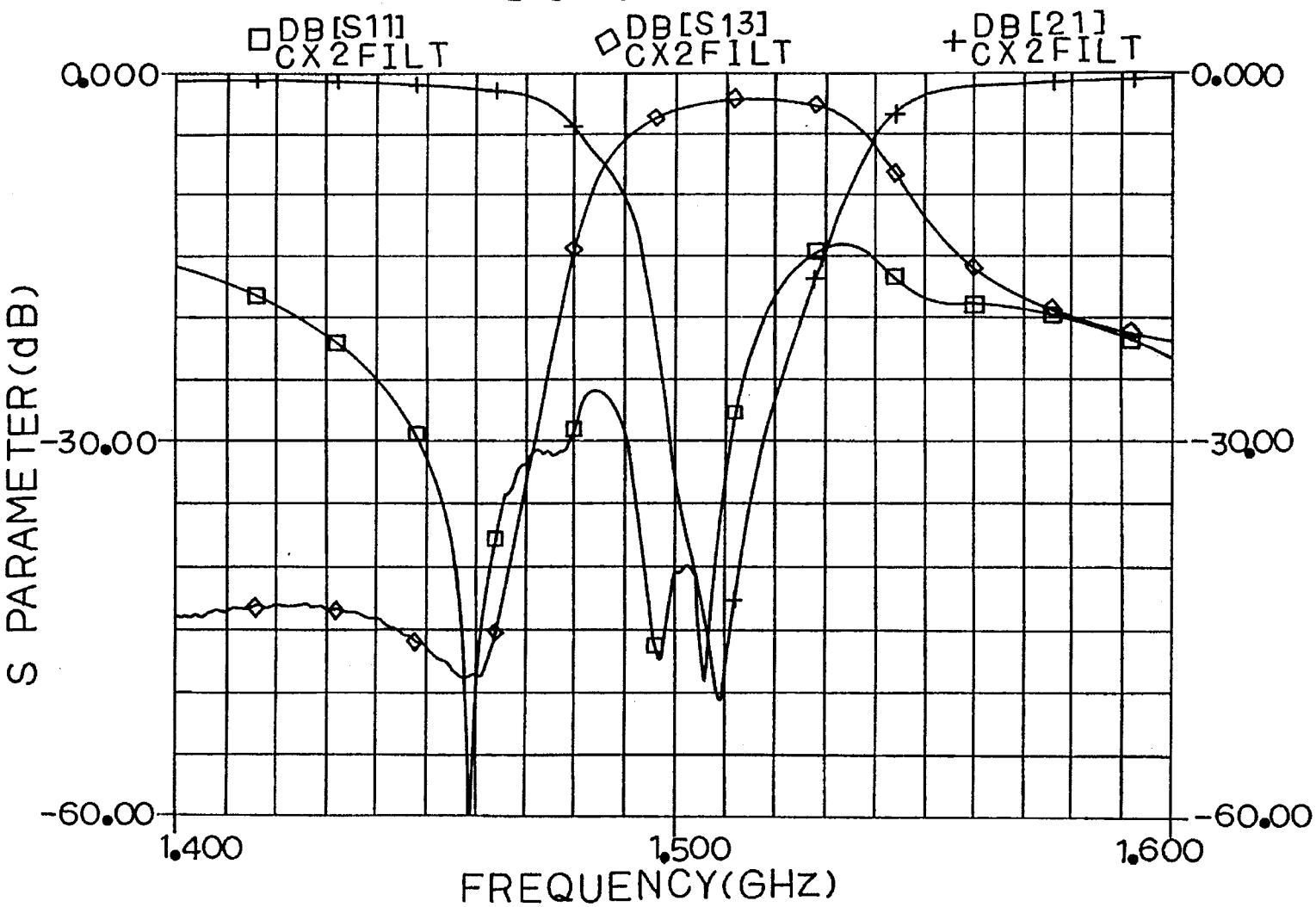
FIG. 5 is a view showing the second embodiment of the antenna duplexer according to the present invention.

FIG. 5 shows the characteristics of the antenna duplexer according to the embodiment shown in FIG. 4.

Figure 7:
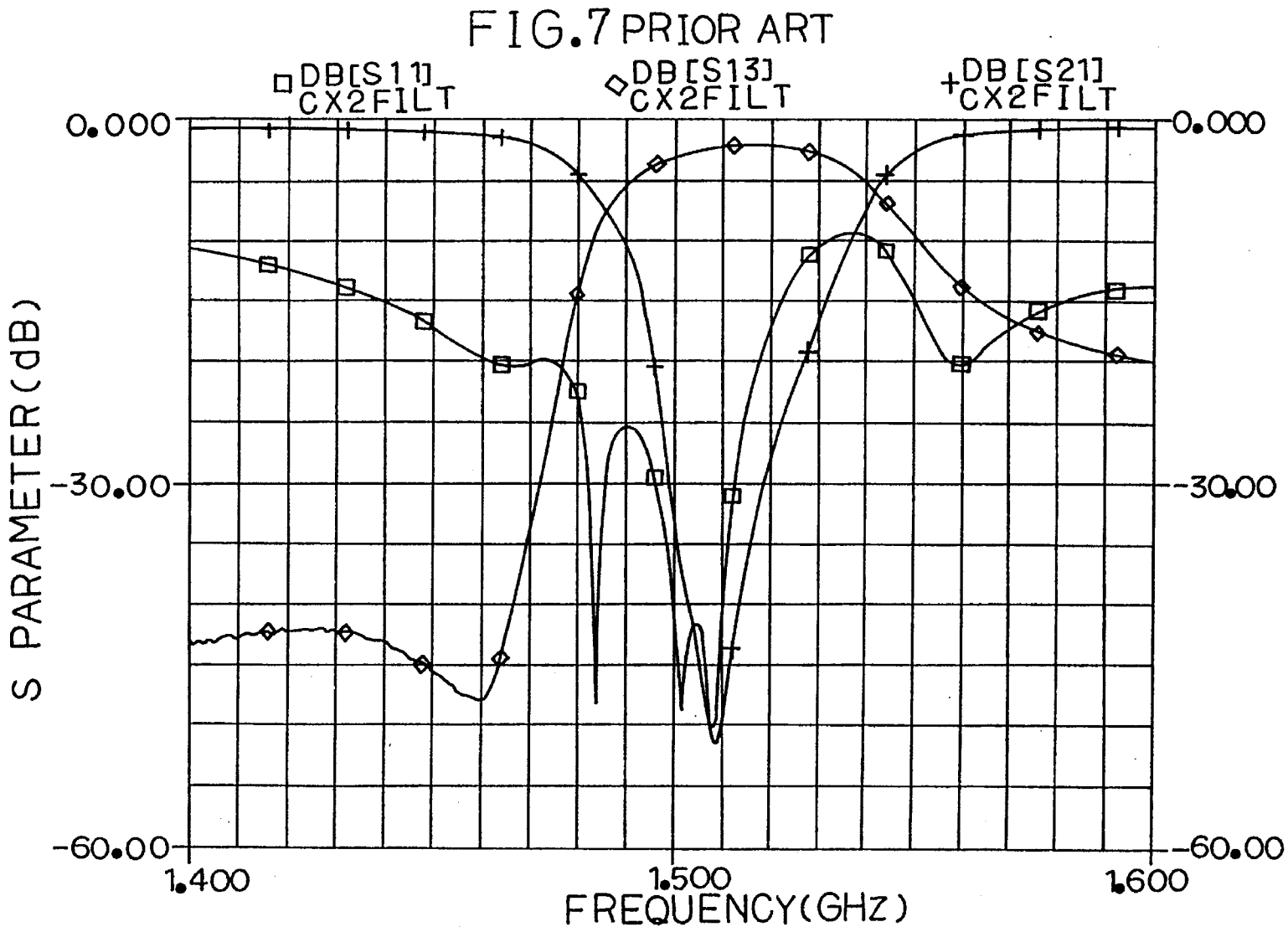
FIG.7 PRIOR ART
FIG. 7 is a view showing the antenna duplexer shown in FIG. 6.

As apparent from the characteristic view of FIG. 5, approximately the same characteristics as those shown in FIG. 3 are obtained even in the antenna duplexer of the construction shown in FIG. 4. Particularly in the vicinity of 1.459 GHz, a reflection loss (S11) on the side of the antenna shared terminal is 60 dB. It is found that the reflection loss is significantly improved, as compared with the reflection loss in the conventional example shown in FIG. 7, i.e., approximately 20 dB. The reflection loss of 60 dB shows that the reflection of the wave occurs by only one millionth of input power, so that; a significantly good matched state is obtained.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An antenna duplexer having a filter for wave receiving and a filter for wave transmission, respective one ends of both the filters being connected to an antenna shared terminal through a matching circuit which includes transmission lines, wherein a characteristic impedance of at least one of the transmission line connecting said antenna shared terminal and said filter for wave receiving to each other and the transmission line connecting said antenna shared terminal and said filter for wave transmission to each other is a value other than a standard characteristic impedance of a receiver circuit and a transmitter circuit connected to said antenna duplexer, and a total impedance of said filters for wave transmission and wave receiving and the respective transmission lines is said standard characteristic impedance.

2. The antenna duplexer according to claim 1, wherein each of said filter for wave receiving and said filter for wave transmission is constituted by a respective plurality of dielectric coaxial resonators.

3. The antenna duplexer according to claim 1, wherein said transmission line comprises a strip line.

4. The antenna duplexer according to claim 3, wherein said transmission line comprises at least two parts coupled together by one of a capacitive element and an inductive element.

5. The antenna duplexer according to claim 4, wherein said capacitive element is constituted by a chip capacitor, and said inductive element is constituted by a pattern inductor.

6. An antenna duplexer having a filter for wave receiving and a filter for wave transmission, each of the filters having two ends, one end of said two ends of each of the filters being connected to an antenna shared terminal through a matching circuit which includes transmission lines, wherein in a case where a characteristic impedance, a propagation coefficient and a line length of each of said transmission lines are respectively taken as Zo, β and 1, an input impedance of the filter for wave receiving is taken as Zf, and an input impedance to an end, which is not connected to the filter, of the transmission line is taken as Zin, there is provided a matching circuit constituted by the transmission lines in which the impedance Zo, the propagation coefficient β and the line length l of the transmission line are such that that Zin in the following equation becomes a standard characteristic impedance:

$$Zin = \frac{Zf + j \cdot Zo \cdot \tan\beta \cdot 1}{Zo + j \cdot Zf \cdot \tan\beta \cdot 1} Zo$$

(where j is an imaginary unit).

7. The antenna duplexer according to claim 6, wherein each of said filter for wave receiving and said filter for wave transmission is constituted by a respective plurality of dielectric coaxial resonators.

8. The antenna duplexer according to claim 6, wherein said transmission line comprises a strip line.

9. The antenna duplexer according to claim 8, wherein said transmission line comprises at least two parts coupled together by one of a capacitive element and an inductive element.

10. The antenna duplexer according to claim 9, wherein said capacitive element is constituted by a chip capacitor, and said inductive element is constituted by a pattern inductor.

11. A method of adjusting the matching circuit in an antenna duplexer during manufacture, in which the antenna duplexer has a dielectric filter for wave receiving and a dielectric filter for wave transmission, and wherein each of the filters has two ends, wherein one end of said two ends of each of the dielectric filters is connected to an antenna shared terminal through a matching circuit which includes transmission lines, comprising the steps of:

calculating an input impedance of each of said dielectric filter for wave receiving and said dielectric filter for wave transmission and selecting characteristic impedances of the transmission line connecting said antenna shared terminal and said dielectric filter for wave receiving to each other and the transmission line connecting said antenna shared terminal and said dielectric filter for wave transmission to each other depending on the calculated input impedances.

12. The antenna duplexer according to claim 11, wherein each said transmission line respectively includes a strip line and respectively has an impedance which is adjusted by changing a width of a strip line.

* * * * *